US005283225A

United States Patent [19]

Neumann et al.

[11] Patent Number: 5,283,225

[45] Date of Patent: Feb. 1, 1994

[54] UNDERLAYER OF DYE-DONOR ELEMENT FOR THERMAL DYE TRANSFER SYSTEMS

[75] Inventors: Stephen M. Neumann, Rochester; Richard W. Wheeler, Pittsford; Jack Hayward, Hamlin, all of N.Y.

[73] Assignee: Eastman Kodak Company, Rochester, N.Y.

[21] Appl. No.: 980,893

[22] Filed: Nov. 24, 1992

[51] Int. Cl.[5] ..... B41M 5/035; B41M 5/38

[52] U.S. Cl. ..... 503/227; 428/195; 428/341; 428/478.2; 428/913; 428/914; 430/201

[58] Field of Search ..... 8/471; 428/195, 212, 428/341, 478.2, 913, 914; 430/200, 201, 945; 503/227

[56] References Cited

U.S. PATENT DOCUMENTS 4,716,144 12/1987 Vanier et al. ..... 503/227
5,110,848 5/1992 Igarashi ..... 524/30
5,214,023 5/1993 Aono ..... 503/227

FOREIGN PATENT DOCUMENTS 61-262190 11/1986 Japan ..... 503/227

*Primary Examiner*—Bruce H. Hess
*Attorney, Agent, or Firm*—Harold E. Cole

[57] ABSTRACT

This invention relates to a dye-donor element for thermal dye transfer comprising a support having thereon a dye layer comprising an image dye dispersed in a binder, and wherein the binder has been coated from an aqueous solution and consists essentially of a hydrophilic polymer, said element also having thereon at least one underlayer consisting of a swellable polymer located between said support and said dye layer.

12 Claims, No Drawings

UNDERLAYER OF DYE-DONOR ELEMENT FOR THERMAL DYE TRANSFER SYSTEMS

This invention relates to the use of an underlayer in the dye-donor element of a thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In U.S. Pat. No. 5,110,848, there is a disclosure of a wet dispersion process for dispersing particles of an organic compound in water. The materials which are to be dispersed are color formers or color developers, and not image dyes. These materials are dispersed in water using a mixture of a water-soluble high molecular weight compound, such as polyvinyl alcohol or gelatin, and a particular copolymer, and then heat treated at a temperature above 30° C. There is no disclosure in that patent of using the water-soluble high molecular weight compound alone as the binder, or of using an underlayer.

In Copending U.S. Ser. No. 07/980,895, filed Nov. 24, 1992 entitled "Dye-Donor Element For Thermal Dye Transfer Systems", of Neumann and Guittard, aqueous dispersions for the dye-donor binder have been disclosed, such as gelatin, which are settable. However, the settable polymer must be contained in the formulation at a sufficient concentration to actually undergo setting. This restricts the possible ratio of dye (both image dye and infrared-absorbing dye if one is present) to binder within the limitations of the coating process by fixing the binder concentration in the formulation relative to a desired dye level. This restriction precludes attaining a high dye-to-binder ratio which is advantageous in some systems.

It is an object of this invention to provide a dye-donor element which contains a binder which has been coated from an aqueous solution and which consists essentially of a hydrophilic polymer, and wherein high dye-to-binder ratios can be employed.

It is another object of this invention to provide an aqueous dispersion binder for a dye-donor element which does not have high mottle. It is still another object of the invention to provide an aqueous dispersion binder for a dye-donor element which will avoid environmental hazards by not using organic solvents.

These and other objects are achieved in accordance with this invention which comprises a dye-donor element for thermal dye transfer comprising a support having thereon a dye layer comprising an image dye dispersed in a binder, and wherein the binder has been coated from an aqueous solution and consists essentially of a hydrophilic polymer, said element also having thereon at least one underlayer consisting of a swellable polymer located between said support and said dye layer.

Hydrophilic polymers which are useful in the invention include, for example, gelatin, corn and wheat starch, agar and agarose materials, xanthan gums, and certain polymers derived from acrylamides and methacrylamides as disclosed in U.S. Pat. Nos. 3,396,030 and 2,486,192, some polysaccharides, and polymers with a hydrophilic group from a water-soluble ionic vinyl monomer and a hydrophobic group from an acrylamide or methacrylamide as disclosed in U.S. Ser. No. 742,784, of Roberts et al., filed in Aug. 8, 1991, now abandoned.

The hydrophilic polymer binder of the dye layer in the dye-donor element of the invention can be employed at a coverage of from about 0.1 to about 5 $g/m^2$.

The swellable polymer useful in the invention for the underlayer can be any of the hydrophilic materials disclosed above. In a preferred embodiment of the invention, the underlayer is gelatin. The underlayer can be employed at any concentration useful for the intended purpose. In general, good results have been achieved when the underlayer is employed at a concentration of from about 0.54 to about 11 $g/m^2$. The underlayer may be split into two or more layers if desired.

By use of the invention, substantial improvements in uniformity in dye transfers can be obtained at high dye to binder ratios. Also, since the coating systems are aqueous, environmental hazards are reduced since organic solvents are not used.

Any image dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

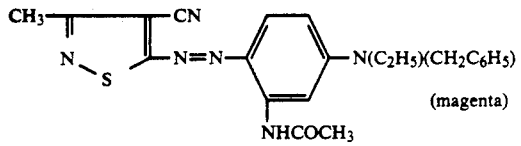

(magenta)

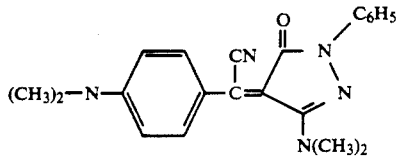

(magenta)

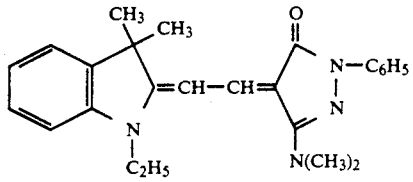

(yellow)

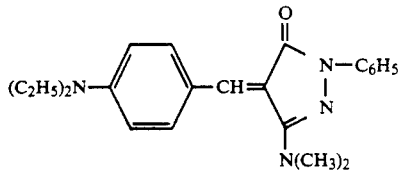

(yellow)

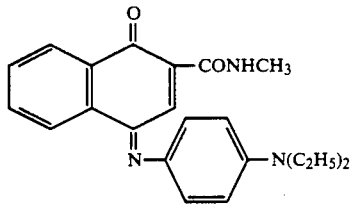

(cyan)

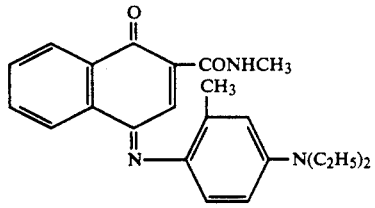

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Peferred lubricating materials include oils or semicrystalline organic solids that melt below 100° C. such as poly(vinyl stearate), beeswax, bayberry wax, candelilla wax, carnauba wax, ceresine wax, Japan wax, montan wax, ouricury wax, rice bran wax, paraffin wax, microcrystalline wax, perfluorinated alkyl ester polyethers, polycaprolactone, silicone oils, poly(tetrafluoroethylene), carbowaxes, poly(ethylene glycols), or any of those materials disclosed in U.S. Pat. Nos. 4,717,711; 4,717,712; 4,737,485; and 4,738,950, and EP 285,425, page 3, lines 25–35. The waxes may be used in combination with silicone oils as mixtures or the waxes may be used to microencapsulate the silicone oils. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek ®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly(vinyl chloride), poly(styrene-coacrylonitrile), polycaprolactone, a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In one embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989,now U.S. Pat. No. 5,168,288, the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

The first magenta dye illustrated above was dispersed in an aqueous medium containing the following surfactant: A2 Triton® X-200 (Union Carbide Corp.). The exact formulation is shown in Table 1

TABLE 1

| COMPONENT | QUANTITY (grams) |
|---|---|
| Magenta Dye | 250 |
| 18.2% aq. Triton ® X-200 A2 Dispersing Agent | 275 |
| Distilled Water | 476 |

The formulation, as shown in Table I, was milled at 16° C. in a 1-liter media mill (Model LME1, Netzsch Inc.) filled to 75% by volume with 0.4 to 0.6 mm zirconia silica medium (obtainable from Quartz Products Corp., SEPR Division, Plainfield N.J.). The slurry was milled until a mean near infrared turbidity measurement indicated the particle size to have been less than or equal to 0.2 μm by discrete wavelength turbidimetry. This corresponded to a milling residence time of 45–90 minutes.

An aqueous carbon black (infrared-absorbing species) dispersion was prepared in a similar manner according to the formulation shown in Table II.

TABLE II

| Carbon Black Dispersion | |
|---|---|
| COMPONENT | QUANTITY (grams) |
| Carbon Black (Black Pearl 430 from Cabot Chemical Co.) | 200 |
| 18.2% aq. Triton ® X-200 A2 Dispersing Agent | 165 |
| Distilled Water | 635 |

CONTROL 1

A poly(ethylene terephthalate) support was coated to give a dry laydown of 0.57 g/m$^2$ of the magenta dye dispersion, 0.22 g/m$^2$ of the carbon black dispersion, and 0.11 g/m$^2$ of de-ionized bovine gelatin (Type IV), coated from water at 4.325 % solids.

CONTROL 2

Another element similar to Control 1 was prepared except that the gel in the dye layer was coated at 0.54 g/m$^2$.

Other elements similar to Control 1 were prepared except that they contained an underlayer or underlayers of gelatin in the amounts recorded in Table III, as well as polydivinylbenzene beads at 0.032 g/m$^2$ and bis(-vinylsulfonyl)methane at 1% by weight.

A "mottle index" was used as measure of the dye dispersion uniformity. This index was determined for the above donor samples using a Tobias Model MTI mottle tester (see P.E. Tobias et al., TAPPI Journal, vol. 72, No. 5, 109-112 (1989)). The donor samples were affixed to a piece of white reflective material which was then taped to the drum of the mottle tester. Sixty-four data readings were averaged for each data point, and each scan of the sample comprised 333 data points. Twenty scans were made of each donor over an area of 50mm×33 mm, with the long dimension perpendicular to the rotating direction. The mottle tester calculates a mottle index for each scan of a 20-scan analysis of the sample. Three such samples were analyzed in this way for each donor coating type, and the mottle index listed in Table III below represents the average of 60 overall scans for each particular donor.

TABLE III

| Gel in Undercoat (g/m$^2$) | Gel in Dye Layer (g/m$^2$) | Dye Mottle Index |
|---|---|---|
| 11* | 0.11 | 104 |
| 5.4** | 0.11 | 111 |
| 2.7 | 0.11 | 104 |
| 0.54 | 0.11 | 252 |
| 0 (Control 1) | 0.11 | 1355 |
| 0 (Control 2) | 0.54 | 77 |

*A two-layer undercoat was used with layer 1 coated directly onto the substrate containing 9.1 g/m$^2$ and layer 2 coated on layer 1 containing 1.9 g/m$^2$.
**A two-layer undercoat was used with layer 1 coated directly onto the substrate containing 3.8 g/m$^2$ and layer 2 coated on layer 1 containing 1.6 g/m$^2$.

The data above show the marked improvement in coating quality achieved by using an underlayer of gelatin (the lower the value of the mottle index, the more uniformly dispersed is the dye in the dye-binder layer of the donor). While the lowest mottle index reading was for a coating which had 0.54 g/m$^2$ of gelatin in the dye layer (an amount which is necessary for the coating to be chill-set), the status A green density for printable coatings with this dye/binder ratio are significantly lower than coatings which had only 0.11 g/m$^2$ of gelatin (see Example 2). Thus, the dye-donors of the invention which have an underlayer can be used with dye layers which have a higher dye-to-binder ratio, thus giving higher densities.

EXAMPLE 2

A dye-donor element having a high dye/binder ratio was prepared by coating on a 100 μm poly(ethylene terephthalate) support the following layers: gelatin (3.77 g/m$^2$) and bis(vinylsulfonyl)methane cross-linking agent (0.054 g/m$^2$); gelatin (1.61 g/m$^2$) and polydivinylbenzene spacer beads (9 μm average particle diameter) (0.02 g/m$^2$); and the magenta dye dispersion of Example 1 (0.57 g/m$^2$), the carbon black dispersion of Example 1 (0.11 g/m$^2$), gelatin (0.11 g/m$^2$) and Fluortenside FT-248® tetraethylammonium perfluorooctylsulfonaee surfactant (Bayer Corp.) (0.007 g/m$^2$).

A control dye-donor element having a low dye/-binder ratio was prepared as above except that the gelatin level was 0.54 g/m$^2$ in the dye layer.

A dye-receiving element was prepared from flat samples (1.5 mm thick) of Ektar® DA003 (Eastman Kodak), a mixture of bisphenol A polycarbonate and poly (1,4-cyclohexylene dimethylene terephthalate) (50:50 mole ratio).

Magenta dye images were produced as described below by printing the magenta dye-donor sheet onto the dye receiver using a laser imaging device similar to the one described in U.S. Ser. No. 457,595 of Sarraf et al, filed Dec. 27, 1989, entitled "Thermal Slide Laser Printer" now U.S. Pat. No. 5,105,206. The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage the position of which was controlled by a lead screw which determined the y axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was an oval of nominally 7 by 9 microns (with the long dimension in the direction of the laser beam sweep). The center-to-center line distance was 10 microns (2451 lines per inch) with a laser scanning speed of 15 Hz.

The laser power was varied over a range as shown in the table below. The following results were obtained:

TABLE IV

| Laser Power | Status A Green Density: High Dye/Binder Ratio | Status A Green Density: Low Dye/Binder Ratio (control) |
|---|---|---|
| Full | 2.2 | 1.7 |
| 86% | 2.0 | 1.5 |
| 73% | 1.5 | 0.6 |
| 59% | 1.1 | 0.4 |
| 45% | 0.7 | 0.3 |

The above results show that the dye-donor elements of the invention have increased efficiency since they enable higher densities to be obtained by using a high dye/binder ratio.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having thereon a dye layer comprising an image dye dispersed in a polymeric material, the improvement wherein aid polymeric material is coated from an aqueous solution and consists essentially of gelatin, and said element also has thereon at least one underlayer consisting of a swellable polymer located between said support and said dye layer.

2. The element of claim 1 wherein said swellable polymer is gelatin.

3. The element of claim 2 wherein said swellable polymer of gelatin is present at a concentration of from about 0.54 to about 11 g/m$^2$.

4. The element of claim 1 wherein said dye-donor element also contains an infrared-absorbing material.

5. In a process of forming a thermal dye transfer image comprising:

a) contacting at least one dye-donor element comprising a support having thereon a dye layer comprising an image dye dispersed in a polymeric material with a dye-receiving element comprising a support having thereon a polymeric dye image-receiving layer;

b) imagewise-heating said dye-donor element; and c) transferring a dye image to said dye-receiving element to form said thermal dye transfer image, the improvement wherein said polymeric material is coated from an aqueous solution and consists essentially of gelating, and said dye-donor element also has thereon at least one underlayer consisting of a swellable polymer located between said support and said dye layer.

6. The process of claim 5 wherein said swellable polymer is gelatin.

7. The process of claim 6 wherein said swellable polymer of gelatin is present at a concentration of from about 0.54 to about 11 g/m$^2$.

8. The process of claim 5 wherein said dye-donor element also contains an infrared-absorbing material.

9. In a thermal dye transfer assemblage comprising:

(a) a dye donor element comprising a support having thereon a dye layer comprising a dye dispersed in a polymeric material, and (b) a dye-receiving element comprising a support having thereon a dye image-receiving layer, said dye-receiving element being in superposed relationship with said dye-donor element so that said dye layer is in contact with said dye image-receiving layer, the improvement wherein said polymeric material is coated from an aqueous solution and consists essentially of gelatin, and said dye-donor element also has thereon at least one underlayer consisting of a swellable polymer located between said support and said dye layer.

10. The assemblage of claim 9 wherein said swellable polymer is gelatin.

11. The assemblage of claim 10 wherein said swellable polymer of gelatin is present at a concentration of from about 0.54 to about 11 g/m$^2$.

12. The assemblage of claim 9 wherein said dye-donor element also contains an infrared-absorbing material.

* * * * *